United States Patent [19]

Dinnissen et al.

[11] Patent Number: 5,012,296

[45] Date of Patent: Apr. 30, 1991

[54] METHOD OF AND COPYING MACHINE FOR COPYING ORIGINALS IN ORDER ON BOTH SIDES OF RECEIVING SHEETS

[75] Inventors: Johannes H. T. Dinnissen; Augustinus W. M. Lambregts, both of Venlo, Netherlands

[73] Assignee: OCE-Nederland B.V., Netherlands

[21] Appl. No.: 321,191

[22] Filed: Mar. 9, 1989

[51] Int. Cl.[5] ..... G03G 21/00

[52] U.S. Cl. ..... 355/320; 355/309

[58] Field of Search ..... 355/308, 309, 318, 319, 355/320

[56] References Cited

U.S. PATENT DOCUMENTS

| | | | |
|---|---|---|---|
| 4,209,249 | 6/1980 | Clark et al. | 355/319 |
| 4,453,819 | 6/1984 | Wada et al. | 355/319 |
| 4,468,114 | 8/1984 | Pels et al. | 355/319 X |
| 4,639,126 | 1/1987 | Bushaw et al. | 355/320 |
| 4,782,363 | 11/1988 | Britt et al. | 355/319 X |

FOREIGN PATENT DOCUMENTS

| | | | |
|---|---|---|---|
| 59-77454 | 5/1984 | Japan | 355/320 |

*Primary Examiner*—Fred L. Braun

*Attorney, Agent, or Firm*—Reed Smith Shaw & McClay

[57] ABSTRACT

The invention described is a method of and machine for duplex copying images present in order on both sides of two original sheets in which, in a first cycle, an image of the first original page is applied twice and then an image of the third original page is applied twice to a separate blank receiving sheets.

Thereafter, in a second cycle, an image of the second original page is applied twice and then an image of the fourth original page is applied twice on the blank side of the returned receiving sheets which were already printed on one side. The two cycles are repeated for making further copies of the two original sheets printed on both sides.

4 Claims, 7 Drawing Sheets

METHOD OF AND COPYING MACHINE FOR COPYING ORIGINALS IN ORDER ON BOTH SIDES OF RECEIVING SHEETS

FIELD OF THE INVENTION

The invention relates to a method of copying at least one group of four originals in order on both sides of receiving sheets, in which, in a first cycle, images are successively applied at a fixed location to one side of a number of receiving sheets which are placed in a circulating path, turned over, and returned to the fixed location where, in a second cycle, images are successively applied to the other side of the receiving sheets. The invention also relates to a copying machine for copying at least one group of four originals.

BACKGROUND OF THE INVENTION

Copying originals onto both sides of a receiving sheet is generally known. See U.S. Pat. No. 4,453,819 and Research Disclosure February 1980, No. 190, page 61, No. 19015. See also Japan A-5977451 and U.S. Pat. Mo. 4,209,249 in which images of all even numbered originals are applied to one side of receiving sheets in a first cycle, the receiving sheets are stored in a stack and then images of all odd numbered originals are applied to the other side of the receiving sheets in a second cycle In Disclosure 19015 a circulating path having space for two sheets is disclosed.

In U.S. Pat. No. 4,453,819 a copying machine for copying at least one group of four originals in order on both sides of receiving sheets is shown. It comprises an imaging device for forming a transferable image on an image support, a fixed location consisting of an image transfer station for transferring the transferable image to a receiving sheet, first conveyor means for conveying receiving sheets through the image-transfer station and a circulating path with second conveyor means and a turnover device in which receiving sheets after passing the image-transfer station are turned over so that the receiving sheets can be conveyed through the image-transfer station in the turned-over position, the circulating path having a length sufficient to receive a number of receiving sheets.

In the method and a copying machine of this kind as described therein a number of receiving sheets equal to or smaller than the maximum number of receiving sheets that the circulating path can hold is brought into the circulating path after images have been formed on one side thereof.

During a first cycle a number of odd-numbered pages of a group of originals is copied and in a second cycle a number of even-numbered pages of this group of originals is copied, the numbers being equal to or less than the maximum number of receiving sheets that the circulating path can hold. The odd-numbered pages and the even-numbered pages may be numbered in sequence or identically.

If the odd and even pages are copied in numerical order, respectively, in two cycles, the circulating path will not be completely filled if the group of originals comprises less pages than the maximum number of receiving sheets that the circulating path can hold. Even if the same odd page and the same even page are copied a number of times respectively in the two cycles, the circulating path will not be completely filled if the number of times that the group of originals is to be copied is to be less than the maximum number of receiving sheets that the circulating path can hold.

If a plurality of pages sizes is used the length of the circulating path will generally have to be equal to or greater than the length of the longest receiving sheet that is to be printed on both sides as considered in the direction of passage In practice, this length may be many times greater than the length of the standard receiving sheets normally used in copying. The term "standard receiving sheets" in this context denotes the smallest size customary for the copying machine used with the method.

In the above known method, the circulating path is much longer than the length of receiving sheets normally used and the receiving sheets are taken through the circulating path at an accelerated speed. The acceleration increases as number of receiving sheets filling circulating path decreases. Such acceleration is a source of conveying malfunctions in the circulating path. Of course, this also applies to the deceleration of a receiving sheet in the circulating path following the acceleration.

Accordingly, it is an object of the present invention to provide a method and a copying machine of the kind referred to above wherein it is possible to carry out a high diversity of copying tasks, including tasks in which a small group of originals is required to be copied on both sides a large number of times, and tasks in which a large group of originals is to be copied on both sides a small number of times, without any loss of time and with little risk of malfunction occurring in the conveyance of receiving sheets in the circulating path.

SUMMARY OF THE INVENTION

Generally, the present invention provides a method in which during a first cycle an image of the first original is applied at least twice and then, the same number of times, an image of the third original is applied to separate receiving sheets. In a second cycle the same number of images of the second original and the same number of images of the fourth original are applied to the blank side of the returned single-sided copies, the two cycles are repeated as necessary to make subsequent copies of that group of originals.

As a result, if the circulating path can hold an even number of receiving sheets, such number being equal to or greater than four, the circulating path can be completely filled with receiving sheets. This is true even if the number of original pages supplied for double-sided copying is equal to the maximum number of receiving sheets that the circulating path can hold or a multiple thereof and if the number of times that original pages supplied for copying is equal to half the maximum number of receiving sheets that the circulating path can hold or a multiple thereof.

In one embodiment, in which the originals are present in order on both sides of original sheets, the images to be applied are obtained by imaging one side of each original sheet at least twice in an imaging device, per group of two original sheets, then feeding the original sheets onto a circulating path, turning them over, returning them to the imaging device, and imaging the other side of each original sheet of the group for the same number of times Consequently, not only large numbers of originals, but also a small number of original sheets printed on both sides, can be copied in order on both sides of receiving sheets a number of times without interruption.

According to the invention, the copying machine includes a control means which, in a first cycle:

a) activates the imaging device for successively forming a transferable image of a first original a number of times and for forming, for the same number of times, a transferable image of a third original on the image support, said numbers corresponding to half the maximum number of receiving sheets of the customary size that the circulating path can hold, and b) activates the first and second conveyor means in order to feed at appropriate times through the image-transfer station and in the circulating path the maximum number of receiving sheets of the customary size that the circulating path can hold in order to transfer the transferable images to one side of said receiving sheets, and which in a second cycle c) activates the imaging device of successively forming for the same number of times an image of a second original and for forming, for the same number of times, an image of a fourth original on the image support, and d) activates the first and second conveyor means for again feeding the turned-over receiving sheets through the image-transfer station in order to transfer the images of the second and fourth original to the other side of the receiving sheets.

The invention is explained in detail hereinafter with reference to the accompanying drawings.

PRESENTLY PREFERRED EMBODIMENT

Figure 1:
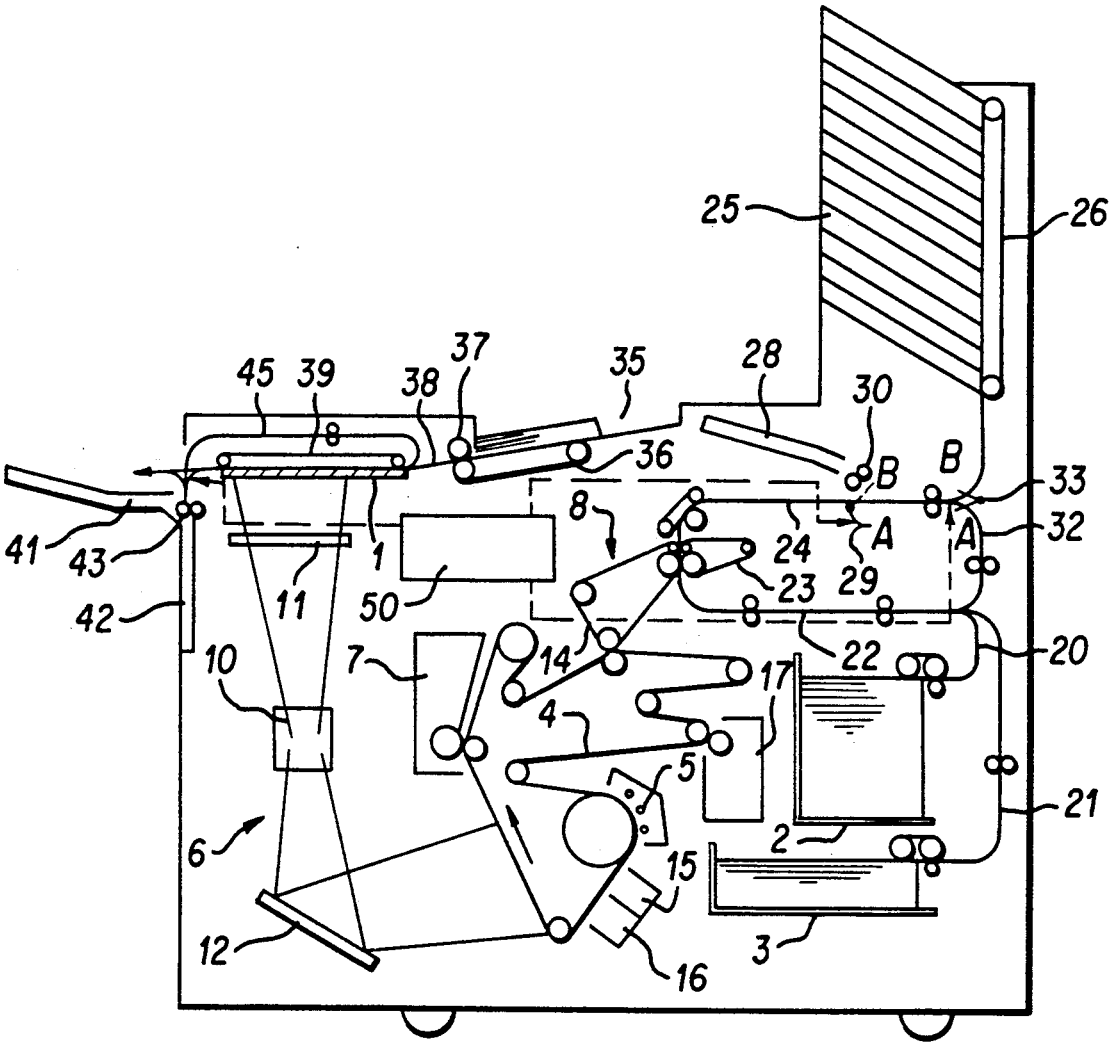
FIG. 1 is a cross-section of a copying machine in which the method according to the invention can be applied.

The copying machine represented in FIG. 1 has a platen 1 on which an original sheet can be placed and magazines 2 and 3 from which sheets of receiving material can be fed through the copying machine to receive an image of an original sheet on platen 1. The copying machine is also provided with a continuously movable photoconductive belt 4 and, disposed along it, processing stations for forming an image of an original sheet on belt 4 and transferring the resulting image to a supplied receiving sheet.

The processing stations comprise a charging device 5 for applying electrostatic charge to belt 4, an exposure system 6 for exposing charged belt 4 image-wise in accordance with the original, a developing device 7 for depositing developing powder on the charge image formed by the image-wise exposure, and an image-transfer system 8 which transfers this powder image and fixes it on a receiving sheet fed from magazine 2 or 3. Exposure system 6 comprises a lens 10 which projects onto the moving photoconductive belt 4 via a mirror 12 an original sheet exposed by a flash lamp 11. The imaging ratio can be altered by adjusting the optical system, e.g., in order to copy an original sheet on a receiving sheet, the formats of the sheets differing. The image-transfer system 8 comprises an endless belt 14 which can receive an image developed on photoconductive belt 4 and then transfer it to a sheet of receiving material fed from magazine 2 or 3. A cleaning device 17 removes developing powder which remains on photoconductive belt 4 after the image transfer. A longitudinal margining device 15 and a transverse margining device 16 are also disposed next to the photoconductive belt 4 to uncharge edge zones of that area of the photoconductive belt 4 on which an image of the original on the platen 1 is imaged by means of exposure system 6. When copying is carried out on standard receiving sheets normally used for copying, the areas of the photoconductive belt on which the images are formed, including &he edge zones belonging to each area, are situated at places distributed regularly over photoconductive belt 4.

Magazine 2 is adapted to receive a stack of receiving sheets of the conventional A4 size, these sheets being situated with the short side parallel to the direction of sheet feed. Magazine 3 is adapted to receive a stack of receiving sheets of a larger size, e.g., A3.

A sheet conveyor path 20 extends from magazine 2 and a sheet conveyor path 21 extends from magazine 3 and both paths lead into a common sheet feed path 22 which extends to an image transfer nip formed between the endless image transfer belt 14 and an endless contact-pressure belt 23. A sheet discharge path 24 extends from the image transfer nip and leads to a sorting device 25 consisting of a number of superposed receiving bins, an endless conveyor belt 26 extending vertically along the bins and, not shown, deflecting elements at each bin to deflect selectively into one of the bins a receiving sheet fed through sorting device 25 by conveyor belt 26.

A turnover path 28 is provided adjacent the sheet discharge path 24 and is accessible via a switch 29 when the same is in the broken-line position B. The solid-line position A is used in cases immaterial to the invention. Disposed in the turnover path 28 is a pair of conveyor rollers 30, the direction of rotation of which is reversible after this pair has fed a receiving sheet completely into the turnover path, in order to feed the receiving sheet from the turnover path back into the sheet discharge path 24, where the receiving sheet - now turned over—is fed further A sheet return path 32 is provided between the sheet discharge path 24 and the sheet feed path 22 and connects the first two paths. The sheet return path 32 is accessible from sheet discharge path 24 via a switch 33 which can occupy two positions a solid-line position A, in which the part of the sheet discharge path 24 leading to the sorting device 25 is accessible, and a broken-line position B in which the sheet return path 32 is accessible.

Together with the sheet feed path 22, the sheet discharge path 24 and the turnover path 28, the sheet return path 32 forms a closed circulating path. This circulating path has a length such that it can simultaneously contain four receiving sheets of standard A4 size at such distances that each receiving sheet as it passes through the image transfer nip can receive an image applied to a subsequent fixed imaging section on the photoconductive belt. Taking into account the distance of, for example, 30 mm between consecutive receiving sheets in the circulating path, to allow for the control of a copying machine, the length of the circulating path is at least $4 \times 210$ mm$4 \times 30$ mm$=960$ mm.

At the top of the copying machine next to the platen there is a feed tray 35 in which can be placed a stack of original sheets to be copied in order and with the first page at the bottom. The original sheets can be fed one by one from the bottom of the stack to a feed path 38 leading to the platen 1, by means of a feed belt 36 and a separating roller 37 cooperating therewith. A conveyor belt 39 rests on the platen 1 and can be driven in the direction of the arrow in order to position a fed original sheet on the platen and, after exposure, discharge the said original sheet from the platen on that side of the platen which is situated opposite feed path 38.

Figure 1A:
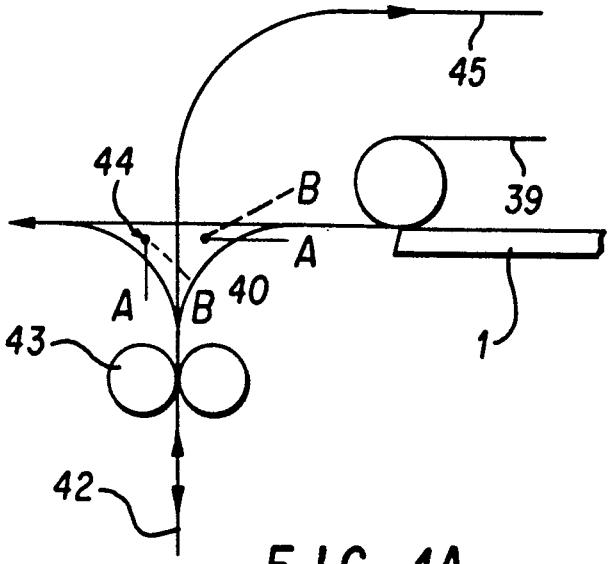
FIG. 1A is an enlarged detail of FIG. 1.

A switch 40 (shown in FIG. 1A) is provided on the discharge side and can occupy two positions. In the solid-line position A, an original receiving tray 41 is accessible while in the broken-line position B a turnover path 42 is accessible which extends downwards next to the platen 1. A pair of conveyor rollers 43 is disPosed in the turnover path 42, the direction of rotation of said rollers being reversible after said pair of rollers has fed an original sheet completely into the turnover path 42, in order to convey the original sheet on in the turned-over position.

A switch 44 (also shown in FIG. 1A) is disposed at the outlet of the turnover path 42 and can occupy two positions: in the solid-line position A an original sheet fed from the turnover path 42 is fed to a return path 45 while in the broken-line position B an original sheet fed from the turnover path 42 is deflected to the receiving tray 41. The return path 45 extends parallel to the platen 1 above the conveyor belt 39 and near the platen leads into the original feed path 38. Together with the sheet path on the platen and the turnover path 42, the return path 45 forms a closed circulating path. This circulating path has a length equivalent to three-quarters of the length of the circulating path for receiving sheets.

The copying machine is provided with a control system 50 which activates the processing stations of the copying machine at the intended times for forming on the photoconductive belt 4 an image of an original situated on the platen and for the transfer of that image to a receiving sheet fed from magazine 2 or 3. The copying machine can be set to a first copying mode for copying single-sided originals to form single-sided copies, and a second copying mode for copying a number of double-sided original sheets in the feed tray 35 to form double-sided copies.

In the case of setting to the first copying mode for single sided copies, the control system 50 sets switches 29, 33 and 40 into the positions denoted by A. This setting causes the control system to activate at the intended times the feed system for the original sheets, imaging system 6, and the feed system for the receiving sheets, so that each original sheet fed from feed tray 35 onto platen 1 is copied for the selected number of times on consecutively supplied receiving sheets. The receiving sheets are deposited in consecutive sorting bins of sorting device 25. In the case of setting to the first copying mode, the original sheets placed in the feed tray 35 may be of either A4 or A3 size while the receiving sheets supplied may also be of A4 or A3 size.

When the copying machine is set to the second copying mode for copying double-sided originals, to produce double-sided copies, the control system sets switches 29, 33 and 40 into the broken-line positions denoted by B.

For copying A3 originals on A3 receiving sheets a plurality of times, the front sides of a maximum of two consecutively supplied original sheets are successively each copied on one side of a maximum of two consecutively supplied receiving sheets The original sheets and receiving sheets are turned over in their own circulating path and returned to platen 1, and the image transfer nip between belts 14 and 23, respectively for copying the reverse sides of the A3 originals on to the other sides of the A3 receiving sheets. After the second receiving sheet printed on one side has passed switch 33 control system 50 changes over switch 33, and the A3 receiving sheets printed on both sides, after being turned over a second time in turnover path 28, are deposited in consecutive sorting bins f sorting device 25.

When the copying machine is set to the second copying mode where double-sided A4 originals sheets are to be copied in order on both sides of A4 receiving sheets, the operation of the copying machine will be explained below with reference to FIGS. 2A–2K. For purposes of explanation, it is assumed that two original sheets printed on both sides have been placed in the feed tray and that the number of copies to be made from these two original sheets has been set at two.

Figure 2A:
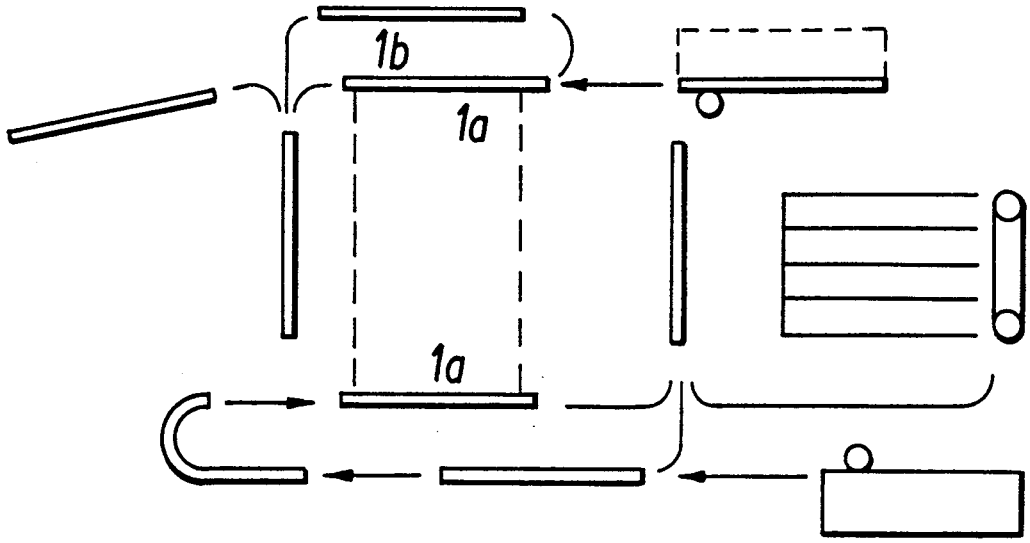
FIG. 2A-2K each diagrammatically illustrate the path of original sheets and receiving sheets in a copying machine according to FIG. 1 in consecutive stages of processing.
Figure 2B:
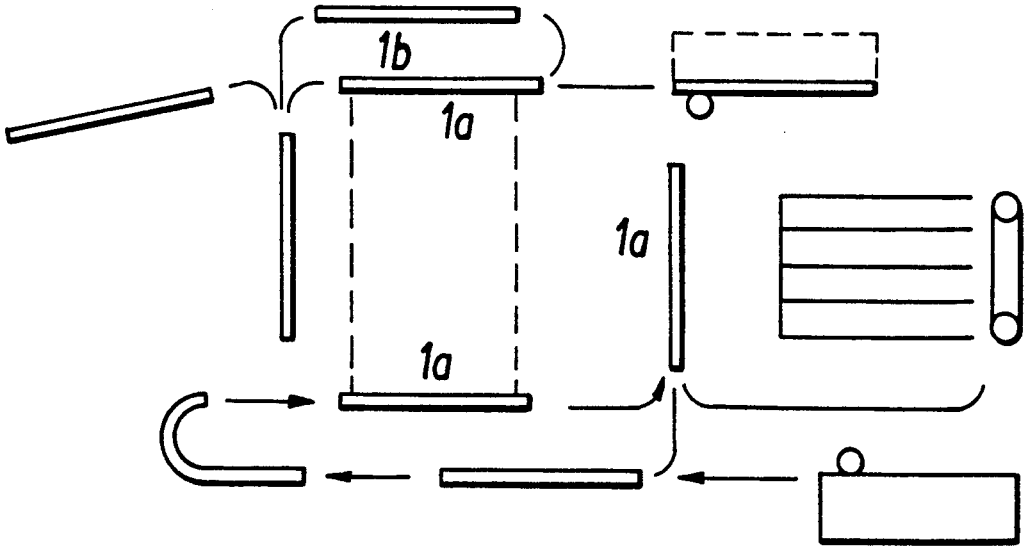
Figure 2C:
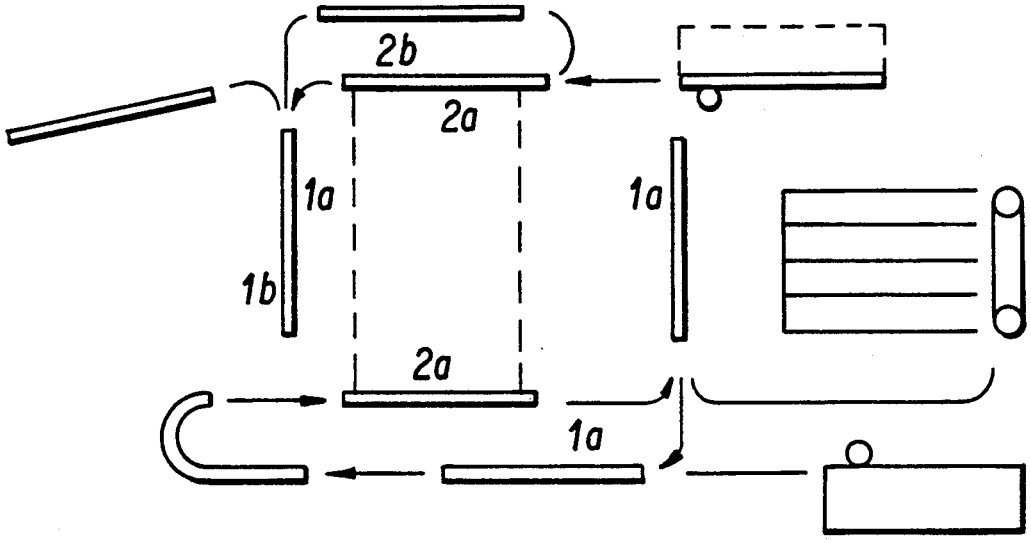
Figure 2D:
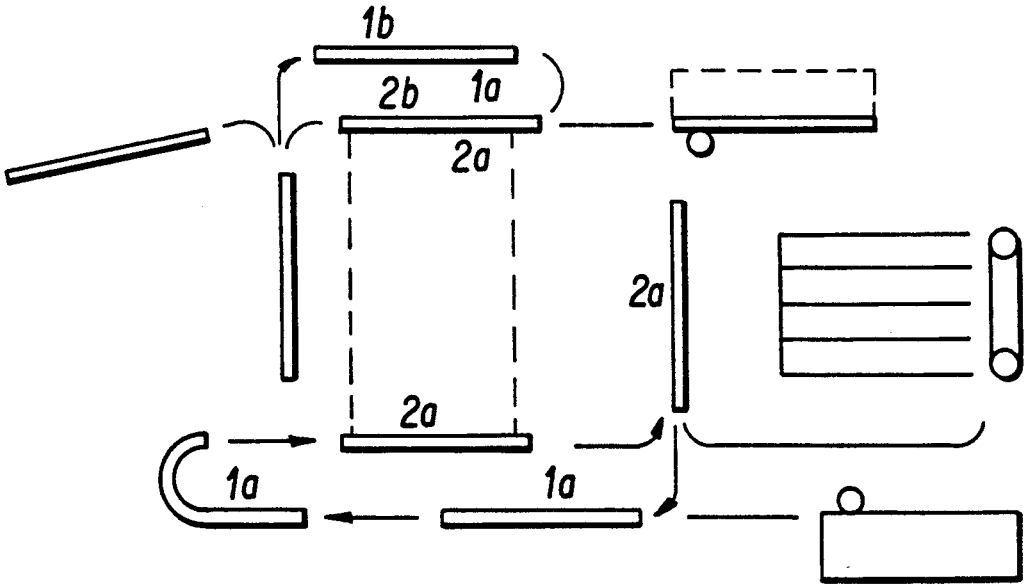

The first original sheet is fed from the feed tray to the platen and the first receiving sheet is fed from a magazine at such times that side of original sheet number 1 is applied to side a of receiving sheet number 1 as illustrated diagrammatically in FIG. 2A. FIGS. 2B–2K diagrammatically illustrate consecutive situations in which the photoconductive belt is in each case moved on over a distance of an imaging section. In the situation illustrated in FIG. 2B, in comparison with the situation illustrated in FIG. 2A, receiving sheet number 1 has been brought into the turnover path and the next receiving sheet has been brought into the image receiving position. In all, four receiving sheets have now been placed in the circulating path and the supply of receiving sheets from the magazine is interrupted. Going from the situation illustrated in FIG. 2A to the situation illustrated in FIG. 2B, original sheet number 1 remained in its position because the control system keeps the conveyor belt on the platen stationary. Thus in the position illustrated in FIG. 2B side a of original sheet number 1 is also being copied on the next receiving sheet.

The control system then activates the drive for the conveyor belt on the platen, original sheet number 1 being brought from the platen into the circulating path and original sheet number 2 being brought from the feed tray on the platen 1. Side a of original sheet number 2 is then applied to side a of the last two receiving sheets brought into the circulating path. These situations are illustrated respectively in FIGS. 2C and 2D. Between he situations illustrated in FIGS. 2C and 2D, in which the original sheet number 2 is again stationary on platen 1, original sheet number 1 has been moved on in the circulating path.

Figure 2E:
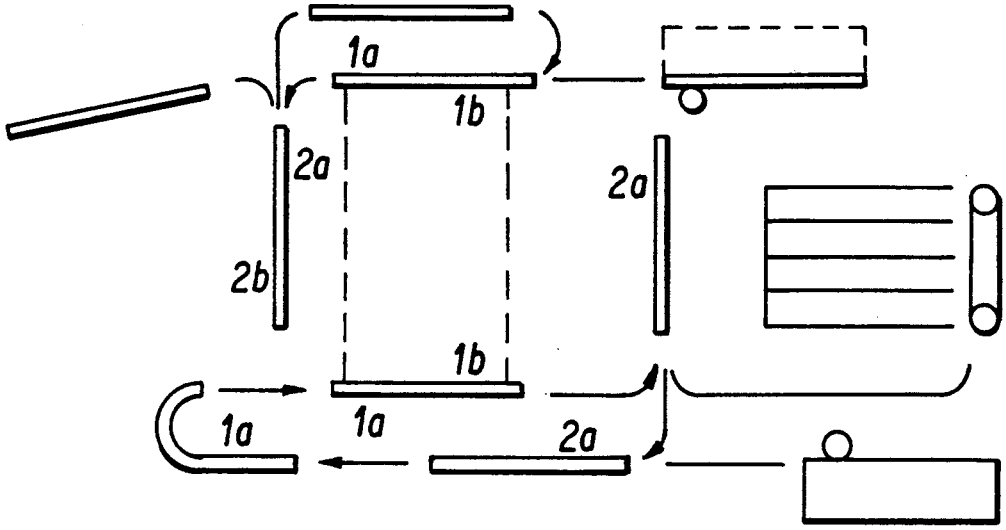
Figure 2F:
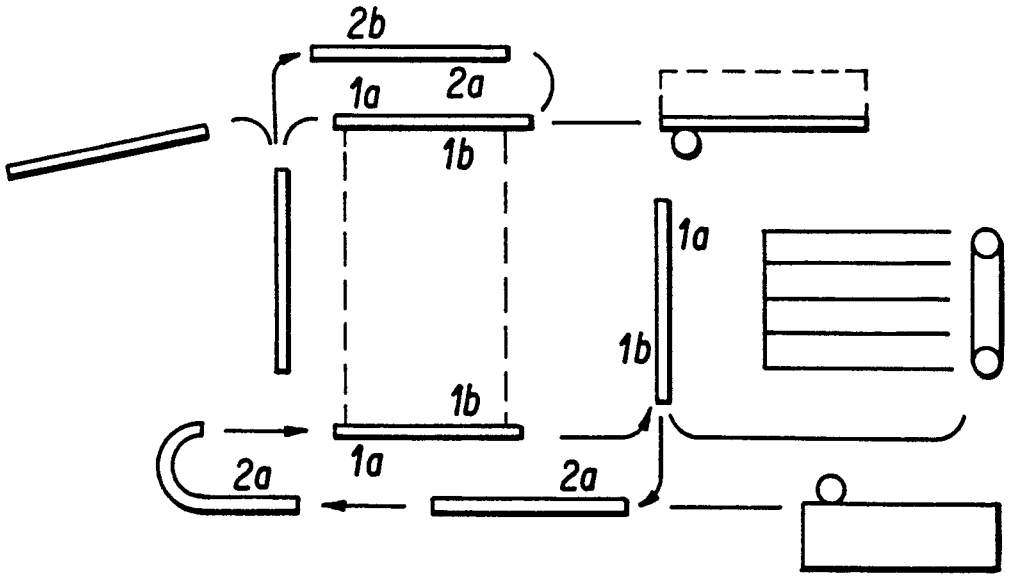
Figure 2G:
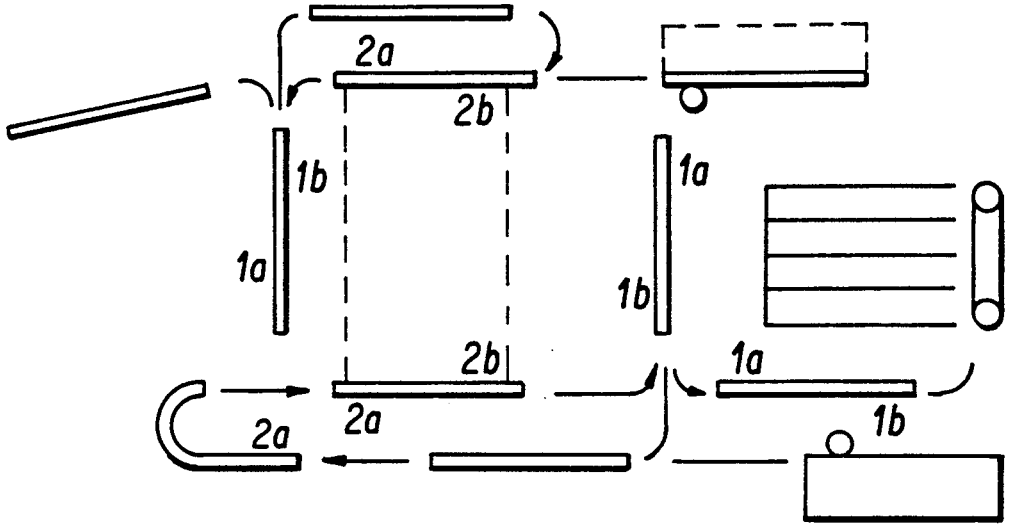
Figure 2H:
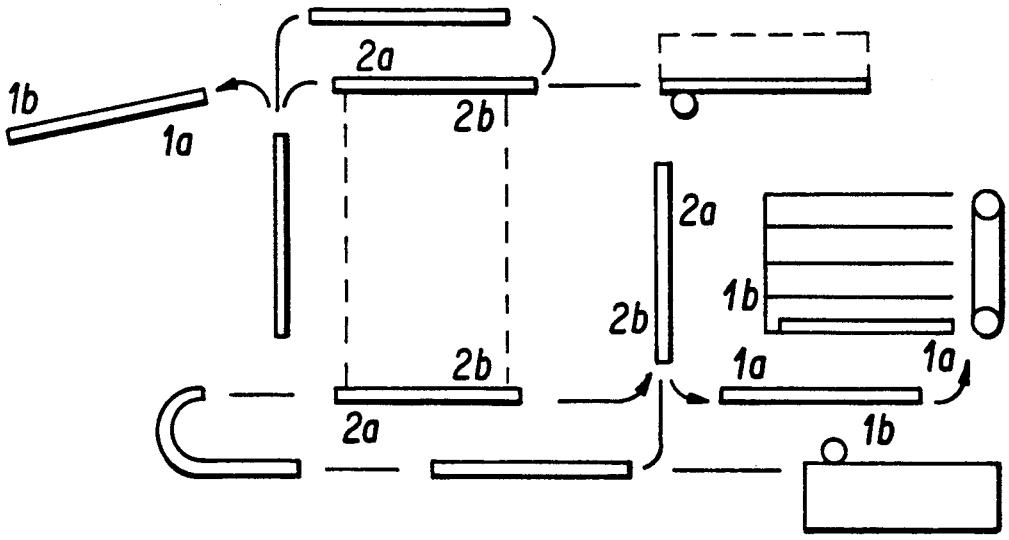
Figure 2I:
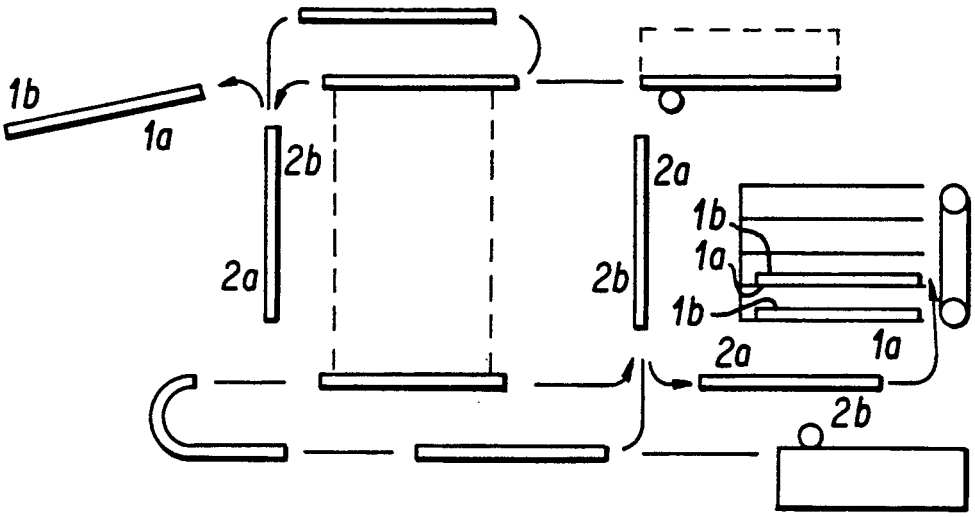
Figure 2J:
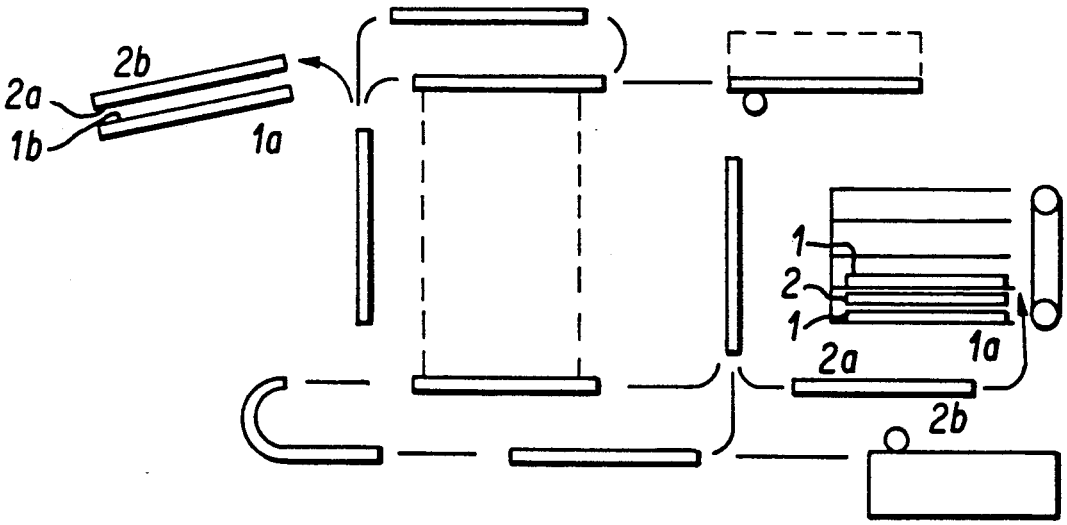
Figure 2K:
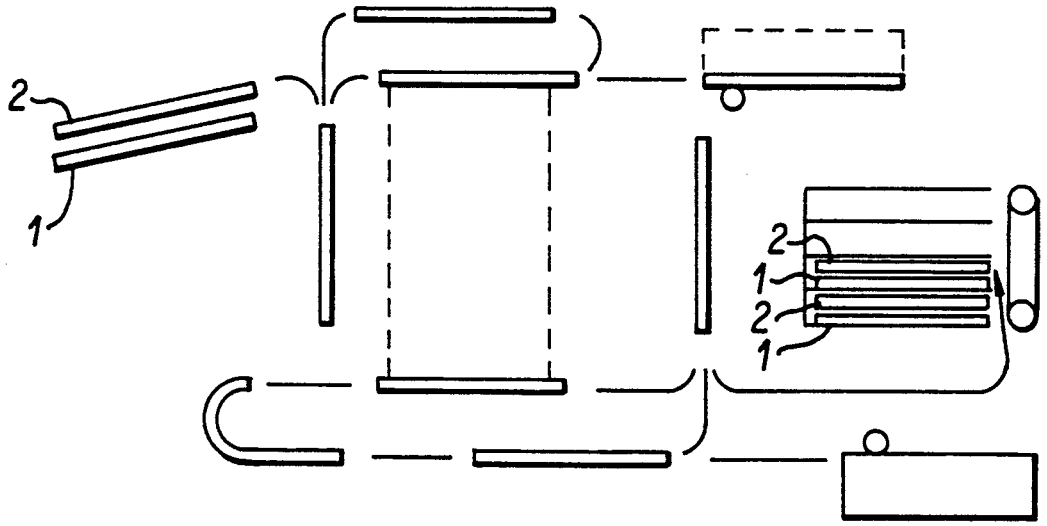

In the next situations illustrated in FIGS. 2E and 2F, original sheet number 1 is again placed on the platen where, lying in the turned over position in this case, it is exposed to light twice in succession. Since, in the situations illustrated in FIGS. 2E and 2F, the first and the second receiving sheet printed on one side have been returned in the circulating path to the image-receiving position, in this position they each receive on their blank side an image of side b of original sheet number 1. After the last receiving sheet brought into the circulating path has passed switch 33, this switch is set to position A so that the first two receiving sheets printed on both sides are deposited in two consecutive sorting bins during the following copying cycles, as illustrated in FIGS. 2G to 2I. During the stages when side b of original sheet number 1 is exposed to light twice (FIGS. 2E and 2F), original sheet number 2 moves on in the circulating path in order directly thereafter. in the stages illustrated in FIGS. 2G and 2H, to be copied on the still blank side of the last two receiving sheets brought into the circulating path. When the first original sheet has returned to the turnover path, the original discharge switch 44 is set to the position B in FIG. 1 so that during subsequent stages illustrated in FIGS. 2I to 2K both the original sheets after being turned over are fed to the receiving tray, in which they occupy the same order and orientation as that in which they were originally placed in the feed tray. The receiving sheets are deposited in the consecutive sorting bins in the same stages.

If the copying machine is set to making a multiple of two copies of the two double-sided A4 originals placed in the machine, switch 44 remains in position A and a following receiving sheet is brought into the circulating path between the stages illustrated in FIGS. 2F and 2G. A cycle of stages 2A to 2H thus begins for these next copies in stage 21.

If a multiple of two double-sided original sheets has been placed in feed tray 35, then following upon the situation illustrated in FIG. 2H a following original sheet is fed from the feed tray to the platen and also following upon the situation illustrated in FIG. 2F four receiving sheets are fed from the A4 magazine to the image-transfer station to receive images of the next two original sheets. If the copying machine is set to making an odd number of copies and an even number of double-sided original sheets has been placed in feed tray 35, then one imaging section is always skipped in making the last copy of the original sheets. Starting from the situation illustrated in FIG. 2A, both originals are recirculated as illustrated in FIGS. 2A to 2K, an original side being exposed to light once only in the situations illustrated in FIGS. 2A, 2C, 2E and 2G. The control system adapts the supply of receiving material to these situations by feeding through the copying machine at half the normal frequency those receiving sheets on which the original sheets are copied. In other words, after each imaging section used on the photoconductive belt one imaging section is skipped. The occupation of the imaging sections is as follows, a dash denoting a skipped imaging section: 1*a* - 2*a* - 1*b* - 2*b*.

If the number of double-sided original sheets fed is odd, then the imaging section occupation and the associated passage of original sheets and receiving sheets is as follows: first, two copies are made of each two original sheets, if available, as described hereinbefore with reference to FIGS. 2A to 2K. If, however, only one copy of these two original sheets has to be made, the procedure described above is followed with imaging sections being skipped each time. The number of copies selected is then made of the remaining double-sided original sheet. If that number is equal to or greater than four, one or more groups of four copies are first made, with the imaging section occupation being as follows: 1*a* 1*a* -- 1*b* 1*b* 1*b* 1*b* -- 1*a* 1*a*, with the associated timing of the passage of the original sheet and the four receiving sheets. The remaining number of copies to be made may be one, two or three. Depending on that number the imaging section occupation is as follows:

in the case of one copy: 1*a* --- 1*b* in the case of two copies: 1*a* 1*a* -- 1*b* 1*b* in the case of three copies: 1*a* 1*a* 1*b*.

While presently preferred embodiments of the invention have been shown and described in particularity, the invention may be otherwise embodied within the scope of the appended claims.

What is claimed is:

1. Method of copying at least one group of four originals in order on both sides of receiving sheets, in which, in a first cycle, images are successively applied to one side of a number of blank receiving sheets at a fixed location, the resulting single-sided copies are placed in a circulating path, turned over, and returned to the fixed location where, in a second cycle, images are successively applied to the other side of the receiving sheets, the improvement comprising in said first cycle an image of first original is applied at least twice and the same number of times, an image of said third original is applied to separate blank receiving sheets, and said second cycle for the same number of times an image of the second original and then the same number of times an image of the fourth original are applied to the blank side of the returned single-sided copies, the two cycles being repeated as necessary to make subsequent copies of that group of originals.

2. A method according to claim 1, in which originals are present in sequence on both sides of original sheets, wherein said images to be applied are obtained by imaging one side of each original sheet at least twice in an imaging device, per group of two original sheets, placing said original sheets onto a circulating path and turning them over, returning them to said imaging device, and then imaging the other side of each original sheet of the group for the same number of times.

3. A copying machine for copying at least one group of four originals in order on both sides of receiving sheets, comprising an imaging device for forming a transferable image on an image support, a fixed location consisting of an image-transfer station for transferring the transferable image to a receiving sheet, first conveyor means for conveying receiving sheets through said image-transfer station and a circulating path with second conveyor means and a turnover device in which receiving sheets after passing image-transfer station are turned over so that said receiving sheets can be conveyed through said image-transfer station in a turned-over position, said circulating path having a length sufficient to receive a minimum of four receiving sheets of the smallest size customary for said copying machine, and control means for activating, in a first cycle:

a. said imaging device for successively forming a transferable image of a first original a number of times and for forming, for the same number of times, a transferable image of a third original on said image support, said numbers corresponding to half the maximum number of receiving sheets of the customary size that said circulating path can hold;

b. said first and second conveyor means in order to feed at appropriate times through said image-transfer station and in said circulating path the maximum number of blank receiving sheets of the customary size that said circulating path can hold in order to transfer the transferable images to one side of said receiving sheets, and in a second cycle, activating c. said imaging device for successively forming for the same number of times an image of a second original and for forming, for the same number of times, an image of a fourth original on said image support, and d. said first and second conveyor means for again feeding turned-over receiving sheets through said image-transfer station in order to transfer the images of the second and fourth original to the other side of said receiving sheets.

4. A copying machine according to claim 3, including an exposure station for originals present in order on both sides of original sheets, a third conveyor means for feeding original sheets to and from said exposure station, and a circulating path for original sheets and having a fourth continuously drivable conveyor means and a turnover device in which said original sheets discharged from said exposure station are turned over in order to feed the other side along the exposure station, which circulating path has a length sufficient to receive a minimum of two original sheets in the size customary for the copying machine, an image of an original sheet fed to the exposure station being formed twice each time, and a control means a. in a first cycle activates the third conveyor means for consecutively conveying said first two original sheets to said exposure station and, after one side of each of these original sheets has been exposed twice, feeding said original sheets to said circulating path, and b. in a second cycle activates a third control means for feeding said turned-over original sheets to said exposure station for exposing the other side of each returned original sheet twice.

* * * * *